US006230533B1

(12) United States Patent
Laveran et al.

(10) Patent No.: US 6,230,533 B1
(45) Date of Patent: May 15, 2001

(54) FOLDED TUBE FOR A HEAT EXCHANGER AND METHOD FOR SHAPING IT

(75) Inventors: Jean-Louis Laveran, Asnieres; Jean-Claude Naty, Argenteuil; Michel Potier, Rambouillet, all of (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/458,890

(22) Filed: Dec. 10, 1999

(30) Foreign Application Priority Data

Dec. 11, 1998 (FR) ..... 98 15703

(51) Int. Cl.[7] ..... B21C 37/15; B21D 39/02; B21D 53/06; F28F 1/02

(52) U.S. Cl. ..... 72/177; 72/176; 72/368; 29/890.53; 165/177

(58) Field of Search ..... 72/368, 181, 176, 72/177; 29/890.043, 890.053; 138/115, 171; 165/172, 177, DIG. 537; 228/149, 150, 151, 146, 147

(56) References Cited

U.S. PATENT DOCUMENTS

| | | | | |
|---|---|---|---|---|
| 2,218,127 | * | 10/1940 | Urschel | 301/124.1 |
| 2,401,542 | * | 6/1946 | Booth | 228/150 |
| 4,024,619 | * | 5/1977 | Jonason | 228/150 |
| 4,766,953 | | 8/1988 | Grieb et al. | 165/177 |
| 5,386,629 | * | 2/1995 | Ouchi | 29/490.053 |
| 5,579,837 | * | 12/1996 | Yu | 165/177 |
| 5,765,634 | * | 6/1998 | Martins | 165/177 |
| 5,875,668 | | 3/1999 | Kobayashi et al. | 72/181 |
| 5,890,288 | * | 4/1999 | Rhodes | 29/890.53 |
| 5,931,226 | * | 8/1999 | Hirano | 165/170 |

FOREIGN PATENT DOCUMENTS

| | | | |
|---|---|---|---|
| 0 239 814 | | 10/1987 | (EP) . |
| 0 829 316 | | 9/1996 | (EP) . |
| 2 735 221 | | 12/1996 | (FR) . |
| 2 141 362 | | 12/1984 | (GB) . |
| 40-1108 | * | 1/1965 | (JP) ..... 72/177 |

OTHER PUBLICATIONS

French Search Report Dated Aug. 18, 1999.

* cited by examiner

*Primary Examiner*—Daniel C. Crane
(74) *Attorney, Agent, or Firm*—Morgan & Finnegan LLP

(57) ABSTRACT

A folded tube for a motor vehicle heat exchanger, is made from a metal strip folded on itself so as to form two parallel channels separated by a spacer. The spacer results from the joining of two borders of the strip each being folded at right angles towards the inside of the tube from an outer face. Each of the borders is folded at right angles with respect to the outer face, forming a folded outer edge, and includes a protruding swelling which extends at least on the same side as the outer face of the strip. The invention makes it possible to produce a tube having flat large faces, the continuity of which is assured in the regions close to the spacer and which contributes to better holding of corrugated spacers in the heat exchanger.

30 Claims, 4 Drawing Sheets

FOLDED TUBE FOR A HEAT EXCHANGER AND METHOD FOR SHAPING IT

FIELD OF THE INVENTION

The invention relates to a folded tube for a heat exchanger such as a radiator for cooling a motor vehicle engine.

BACKGROUND OF THE INVENTION

More particularly, the invention relates to a folded tube comprising a metal strip folded on itself so as to delimit two parallel channels separated by a spacer, which, results from the joining of two borders of the strip each folded at right angles towards the inside of the tube from an outer face of the tube, forming a folded outer edge.

Folded tubes of this type are already known, and exhibit a cross-section of flattened shape and possess two flat and parallel large faces, joined together by two small curved faces. Such tubes serve to form a bank of tubes obtained by an alternate stacking of tubes arranged in parallel and of corrugated spacers, forming heat-exchange fins, which extend between the large faces of the tubes.

The ends of the tubes are accommodated with holes of appropriate shape formed by manifold plates which are capped by manifold chambers. The assembly is brazed in an appropriate furnace so as to constitute a heat exchanger.

In the majority of the known tubes of this type, the folded outer edge exhibits a circular-arc shape which results from the folding operation, so that a depression is always created at the surface of the tube at the place where the border is folded inwards. It is therefore necessary to fill in this depression, to ensure continuity of each of the large faces or the tubes in the regions close to the spacer and to ensure leaktightness of the joint between the tubes and the manifold plates of the heat exchanger. Such operation raises a practical difficulty, since it is difficult to fill in this depression conveniently with brazing alloy during the manufacture of the tube.

Tubes of this type are also known in which the folded outer edge exhibits a sharp outer corner, which eliminates the depression mentioned above. However, the shaping of a sharp-cornered outer edge poses practical implementation difficulties Moreover, the known tubes of the abovementioned type all have the drawback of not allowing the corrugated spacers to be held properly, which generally makes it necessary to have special tooling to keep these spacers in the correct position during the brazing of the heat exchanger.

OBJECTS OF THE INVENTION

A primary object of the invention is to at least partly remedy the drawbacks of the prior art.

Another object of an embodiment of the invention is to produce, by folding, a tube which exhibits no depression at the place where the border is folded inwards and which contributes to holding the corrugated spacers which are adjacent to it.

SUMMARY OF THE INVENTION

According to one aspect, the present invention provides a folded tube for a heat exchanger, particularly of a motor vehicle, comprising a metal strip folded on itself so as to delimit two parallel channels separated by a spacer. The spacer results from the joining of two borders of the strip which are each folded at right angles towards the inside of the tube from an outer face of the tube, and a folded outer edge. Each of the folded outer edges includes a protruding swelling which extends at least on the same side as the outer face of the strip.

Each of the borders is folded at right angles, forming a protruding swelling, in such a way that the two borders can be joined together without forming a depression. Hence, during a subsequent brazing operation, the continuity of each of the large faces of the tube in the regions close to the spacer is automatically assured. This also guarantees the leaktightness of the joint between the tubes and the manifold plates of the heat exchanger.

Moreover, these protruding swellings improve the holding of the corrugated spacers by penetrating into the corrugated spacers, which avoids having recourse to special tooling in order to hold them during the brazing.

Furthermore, these protruding swellings contribute to supporting the borders against the inner face of the tube, which is opposite the outer face.

The protruding swelling may extend only on the same side as the outer face of the strip, or may extend both on the outer-face side and on the same side as the border of the strip.

The protruding swelling preferably has a dimension of 0.05 to 0.5 mm.

According to another characteristic of the invention, each of the borders is joined to an inner face of the tube, forming a fillet having a profile substantially of a quarter-circle.

According to another characteristic of the invention, the outer faces to which the borders are connected jointly form a flat large face of the tube.

According to yet another characteristic of the invention, the tube comprises two flat large faces joined together by two inward-curved small faces.

The tube according to the invention is formed from a metal material which is capable of being folded, preferably aluminum or an aluminum-based material.

According to another aspect, the invention relates to a method of shaping a tube as defined above, this method comprising the following operations:

a) providing a flat metal strip of chosen length delimited by two parallel longitudinal edges;
b) continuously deforming each of two marginal regions of the strip so as, by folding, to produce a flat border forming a variable obtuse angle with a central region of the strip which extends between the borders, such way each border is connected with the central region by a folded region of chosen profile;
c) carrying on with the deformation of the strip until each of the borders is connected to the central region by a right angle; and
d) shaping the folded region in such a way as to form an angle of 90° exhibiting a folded outer edge including a protruding swelling.

In one implementation of the method, provision is made that, in operation b), the folded region includes a rib with rounded profile which protrudes on the same side as the reflex angle, that, in operation c), the protruding rib is conserved, and that in operation d), the protruding rib is squeezed to form the protruding swelling.

According to one variant of the method, provision is made that, in operation b), the folded region includes a fold with a rounded profile, that in operation c) the fold is conserved, and that in operation d) the material of the border is made to flow in such a way as to fill in the internal space of the right angle and to obtain the protruding swelling.

According to another characteristic of the invention, each of the operations b), c) and d) is carried out by at by least one set of shaping wheels including a shaping wheel and a counter-wheel.

Advantageously, the method comprises at least one supplementary operation comprising in:

e) continuously deforming the strip in such a way as to bring the two folded borders together against one another so that they jointly constitute a spacer reaching as far as the central region of the strip in order to form a tube with two parallel channels.

Operation e) preferably comprises the deformation of the central region so as to form a flat large face joined by two inward-curved small faces to an opposed flat large face comprising two coplanar parts extending on either side of the folded borders.

According to another aspect, the invention relates to a heat exchanger comprising a multiplicity of tubes as defined above or as obtained by the method above.

BRIEF DESCRIPTION OF THE DRAWINGS

In the description which follows, given solely by way of example, reference will be made to the attached drawings, in which.

DESCRIPTION OF THE PREFERRED EMBODIMENTS

Figure 1:
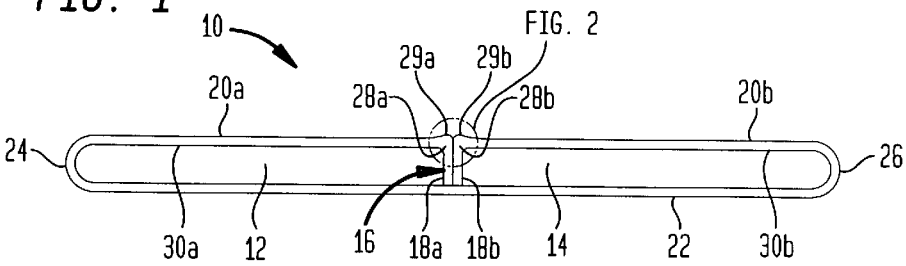
FIG. 1 is an end view of a folded tube according to the invention.

In the various figures, like reference numerals refer to like parts.

Referring first of all to FIG. 1, a folded tube 10 is shown, also called flat or flattened tube, produced from folded and brazed metal sheet, advantageously of aluminum or aluminum-based alloy. The tube 10 consists of a metal strip folded in such a way as to form the casing of two parallel channels 12 and 14. These channels are separated by a spacer 16 produced by the folding at 90° of two borders 18*a* and 18*b* of the metal strip.

These borders are produced by folding from an outer face 20*a*, 20*b* of the tube respectively, and they are joined to one another in such a way as to be back-to-back so as jointly to form the spacer 16. Thus, the respective outer faces 20*a* and 20*b* jointly form a flat large face of the tube 10, which is connected to another flat large face 22 by two small inwards-curved faces 24 and 26.

Figure 2:
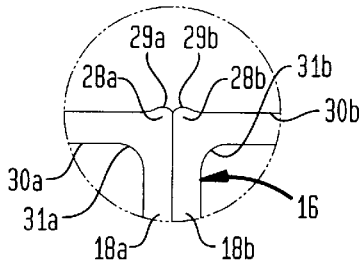
FIG. 2 is a detail of FIG. 1, on an enlarged scale.
Figure 14:
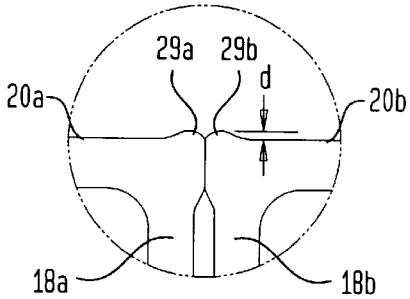
FIG. 14 represents a detail similar to that of FIG. 13 in a variant embodiment.

As can be seen more particularly in the detail of FIG. 2, each of the borders 18*a* and 18*b* is folded strictly at right angles with respect to the corresponding outer face 20*a*, 20*b*, forming a folded outer edge 28*a*, 28*b* which includes a protruding swelling 29*a*, 29*b*. Each swelling 29*a*, 29*b* extends on the same side of the corresponding outer face 20*a*, 20*b* and has a dimension d (FIG. 14) which lies between 0.05 and 0.5 mm.

It results therefrom that the two borders can be joined together without forming a depression between the folded outer edges 28*a* and 28*b*, as was generally the case in the prior art. The edges 28*a* and 28*b* are side-by-side, so that the outer faces 20*a* and 20*b* are in the extension of one another, with no discontinuity.

As can also be seen in the detail of FIG. 2, each of the borders 18*a*, 18*b* is joined to an inner face 30*a*, 30*b* of the tube, forming a fillet 31*a*, 31*b* having a profile substantially of a quarter-circle.

The tube 10 described above can be obtained by shaping a metal strip (FIG. 3) which exhibits two parallel longitudinal edges 32*a* and 32*b*. At the start of the operation, the metal strip is flat, so that the edges 32*a* and 32*b* are opposite one another, as shown in broken line in FIG. 3. The shaping of the tube is carried out by continuous folding operations, starting with the simultaneous formation of the folded borders 18*a* and 18*b*.

The shaping of the folded border 18*a* will now be described, with reference to FIGS. 4 to 9, with the comment that the shaping of the folded border 18*b* is carried out in a similar manner, and simultaneously.

Figure 4:
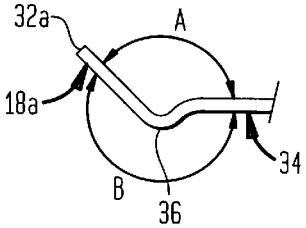
FIG. 4 shows one end of a strip at the start of a folding operation for forming a folded border.

In the first place, a marginal region of the metal strip is folded, this region extending from the longitudinal edge 32*a*, so as to form a border 18*a* which forms an obtuse angle A with respect to a central region 34 of the strip. Hence, this central region 34 is framed by the two borders 18*a* and 18*b*. At the outset, the value of angle A is 180° and reduces progressively, passing through an intermediate phase, as shown in FIG. 4, in which the value of this angle is of the order of 135°.

In accordance with the invention, it is essential, in order subsequently to obtain a folded outer edge 18*a* exhibiting a protruding swelling 29*a*, to form a rib 36 with a rounded profile which protrudes on the same side as the corresponding reflex angle B (this angle being, by nature, greater than 180°). This rib 36 exhibits a rounded profile which is substantially in the shape of a circular arc and has to be deformed progressively in order to form the sharp-angled corner of the outer edge 28.

Figure 5:
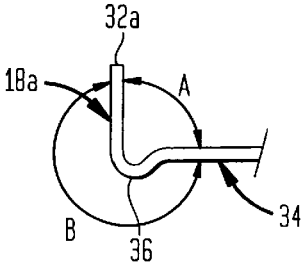
FIG. 5 is a view similar to FIG. 4 in the course of a subsequent operation.

The deforming of the strip is now continued until the border 18*a* (and likewise the border 18*b*) is connected to the central region 34 with a right angle, while conserving the protruding rib 36. Thus an intermediate phase is reached as represented in FIG. 5. In this position, the angle A is 90°, the angle B 270° and the rib 36 still exhibits a circular-arc shape and still protrudes on the same side as the reflex angle B.

Figure 6:
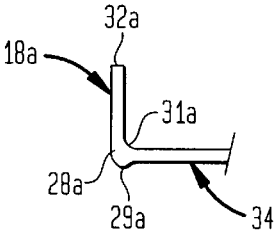
FIG. 6 is a view similar to that of FIG. 5 in the course of a subsequent operation corresponding to the folding of a right-angled border with a sharp corner.

Next, the strip is deformed in the region of the connection of the border 18*a* and the central region 34 in such a way as to squeeze the rib 36 and to obtain an outer edge 28*a* folded at 90° and exhibiting a protruding swelling 29*a*, as shown in FIG. 6. The connection between the border 18*a* and the central region 34 on the inner side is made by a quarter-circular fillet 31*a*. A similar fillet 31*b* is formed at the connection of the border 18*b* and the outer face 20*b* (see FIG. 2).

Figure 7:
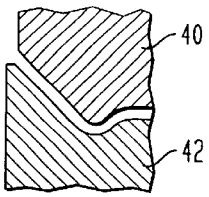
FIGS. 7, 8 and 9 respectively show three sets of shaping wheels (represented partially) making it possible respectively to form the profiles of FIGS. 4, 5 and 6.
Figure 8:
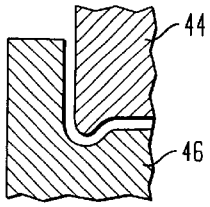
Figure 9:
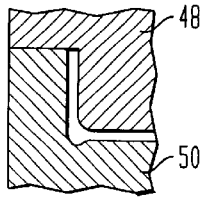

The deforming of the two marginal regions of the strip in order to form the borders 18*a* and 18*b* is done by at least three sets of rotating shaping wheels. In order to form the profile of FIG. 4, a shaping wheel 40 and a counter-wheel 42 are used, having complementary profiles as shown in FIG. 7. In order to produce the profile of FIG. 5, a set of shaping wheels comprising a shaping wheel 44 and a counter-wheel 46 with complementary profiles is used, as shown in FIG. 8. To form the profile of FIG. 6, a set of shaping wheels is used comprising a shaping wheel 48 and a counter-wheel 50 with complementary profiles, as shown in FIG. 9.

Figure 3:
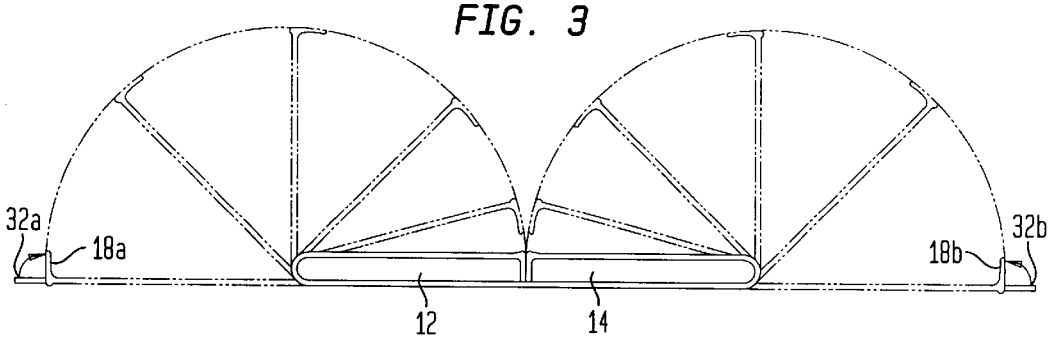
FIG. 3 is an end view of a tube according to the invention in the course of various phases of folding, after previous formation of the right-angled folded borders.

Next, to finish forming the tube, the two folded borders 18*a* and 18*b* are brought together against one another so that they jointly constitute the spacer 16, as FIG. 3 shows. These closing-together operations are carried out continuously by two appropriate sets of shaping wheels so as to form the small inwards-curved faces 24 and 26, which each have a substantially semicircular profile. This deformation carries on until the end of the spacer 16 (i.e., edges 32*a* and 32*b*) comes into abutment against the inner face of the central region 34. At the end of these operations, a tube is obtained which exhibits the profile represented in FIG. 1, with no depression at the junction of the two borders.

Figure 10:
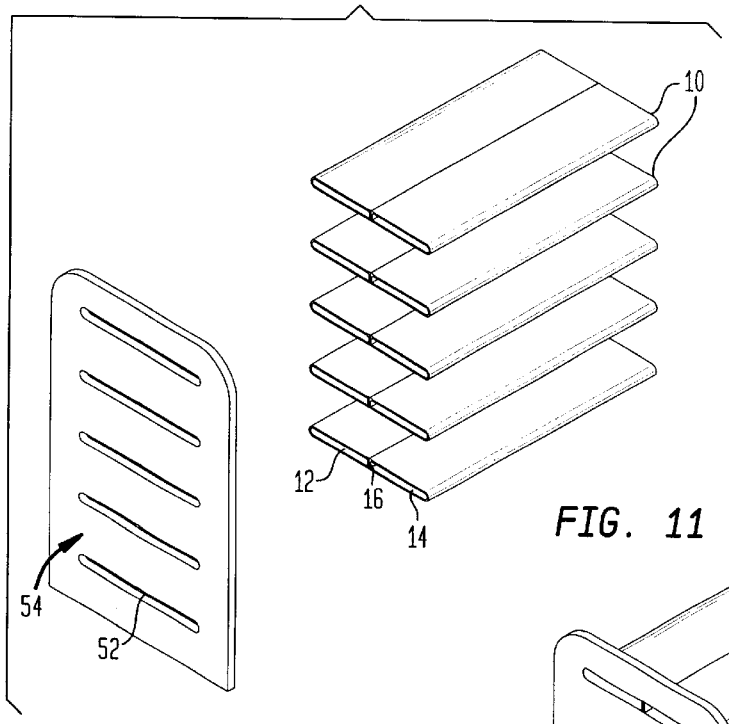
FIG. 10 is an exploded partial view in perspective of a heat exchanger, including tubes folded according to the invention.
Figure 11:
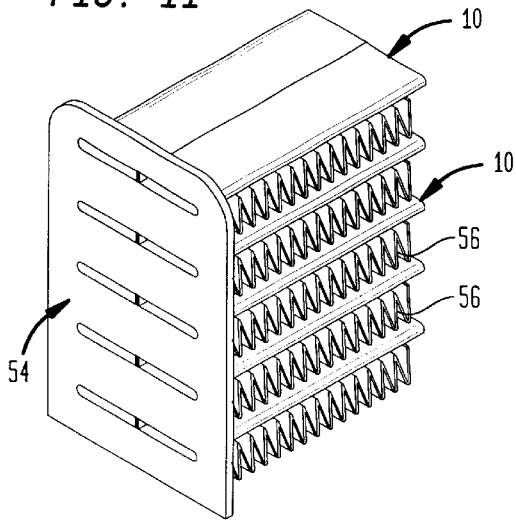
FIG. 11 is a partial view in perspective of a heat exchanger including tubes folded according to the invention.

The tubes 10 can then be engaged in slots 52 of two manifold plates 54, only one of which is represented in FIGS. 10 and 11, on which are mounted the manifold chambers at the end of the heat exchanger.

During the mounting, corrugated-shaped spacers 56 are interposed between the tubes 10, and the assembly is then permanently assembled by brazing.

Because, for each of the tubes 10, the joining of the borders takes place without creating a depression, the continuity of the large faces of the tube is assured in the regions close to the spacer. Moreover, the leaktightness of the joint between the ends of the tubes and the manifold plates 54 is automatically assured.

Figure 12:
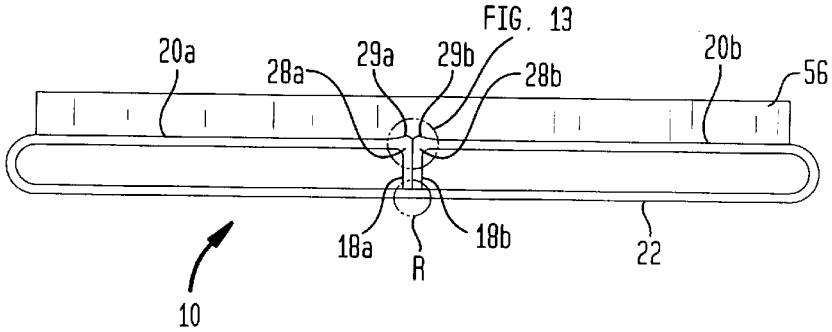
FIG. 12 is an end view similar to FIG. 1 showing a tube and a corrugated spacer.
Figure 13:
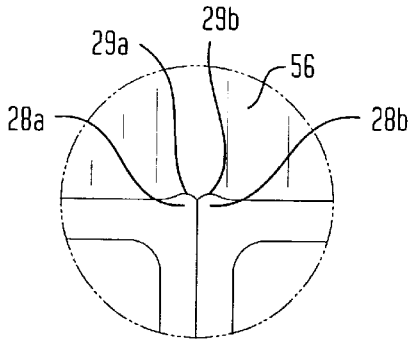
FIG. 13 represents a detail of FIG. 12, on an enlarged scale.

Moreover, as can be seen in FIGS. 12 and 13, when the bank of tubes of the heat exchanger is assembled, the protruding swellings 29*a* and 29*b* of each tube penetrate into the openings of the corrugated spacers 56 which enhances the holding of the latter especially during the brazing operation.

The configuration of the protruding swellings 29*a* and 29*b* is capable of numerous variants. In the embodiment of FIGS. 1 and 2 and that of FIGS. 12 and 13, the swellings protrude only from corresponding outer faces 20*a* and 20*b*, so that the borders 18*a* and 18*b* are in mutual contact. In contrast, in the embodiment of FIG. 14, the swellings 29*a* and 29*b* project both from the corresponding outer faces 20*a* and 20*b* and from the corresponding borders 18*a* and 18*b*.

Figure 15:
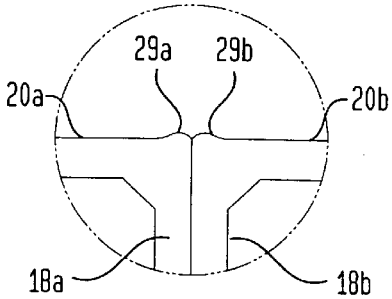
FIG. 15 represents a detail similar to that of FIG. 13 in another variant embodiment.

The variant of FIG. 15 is similar to that of FIGS. 1 and 2 and to that of FIGS. 12 and 13, except that each of the borders 18*a* and 18*b* is connected to the inner face of the tube by an oblique edge and not by a rounded fillet as in the case of the other previously described embodiments.

FIGS. 16 to 19 will now be referred to in order to describe a variant implementation of the method of the invention.

Figure 16:
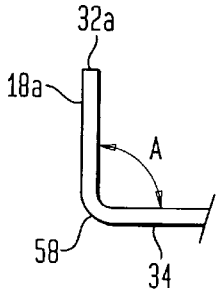
FIG. 16 is a view similar to FIG. 5 showing a strip in the course of folding, as obtained by a variant implementation of the method.

FIG. 16 shows one end of a strip in the course of folding, which constitutes a variant of FIG. 5, in which the border 18*a* is connected by a right angle A to the central region 34 by means of a right-angled fold 58, which exhibits a rounded profile. This fold includes no externally protruding part, in contrast to the rib 36 of FIG. 5.

Figure 17:
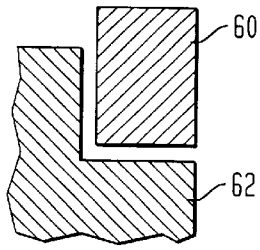
FIG. 17 shows a set of shaping wheels making it possible to produce the profile of FIG. 16.

In order to obtain the profile of FIG. 16, a set of shaping wheels is used comprising a shaping wheel 60 and a counter-wheel 62 with complementary profiles, as shown in FIG. 17. These two shaping wheels make it possible to form the right angle A and the abovementioned fold 58.

The profile of FIG. 16 is such that the border 18*a* extends over a height Hi which is greater than the final height desired for the spacer of the tube.

In a subsequent operation, the material constituting the border 18*a*, including that of the fold 58, is made to flow in order to fill in the inner space of the right angle and to obtain a protruding swelling 29*a* similar to that described previously.

Figure 18:
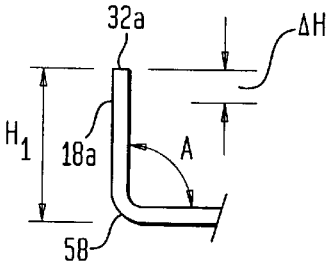
FIG. 18 is a view similar to FIG. 16 showing the strip before a flow operation.
Figure 19:
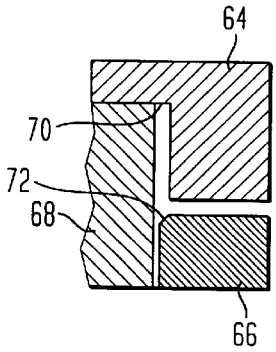
FIG. 19 shows one of the shaping wheels making it possible to form the profile of FIG. 20.
Figure 20:
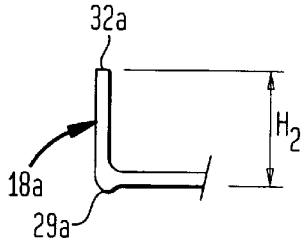
FIG. 20 is a view similar to FIGS. 16 and 18 showing the strip after the flow operation.

To do that, a set of shaping wheels is used comprising a shaping wheel 64 and a counter-wheel 66 with complementary profiles interacting with a lateral support 68. The shaping wheel 64 includes a rim 70 (FIG. 19) suitable for coming into abutment against the longitudinal edge 32*a* of the metal strip. The material of the border is made to flow with the result that, as shown in FIG. 18, the height of the border is reduced by a value ΔH, so as to arrive at a height H2 (FIG. 20) less than the height H1 (FIG. 18).

Moreover, the counter-wheel 66 includes a recess 72 (FIG. 19) which makes it possible to accommodate the material which has been made to flow to form the abovementioned protruding swelling 29*a*.

The invention makes it possible to produce different types of heat exchangers for motor vehicles, such as radiators for cooling the engine or air-conditioning condensers.

What is claimed is:

1. A tube for a heat exchanger the tube comprising:

a metal strip folded on itself so as to delimit two parallel channels separated by a spacer, wherein the spacer comprises two borders of the metal strip joined together, each border folded at a right angle towards the interior of the tube from one of two outer faces of the tube to form a folded outer edge, wherein each of the folded outer edges includes a protruding swelling that extends at least on the same side of the tube as the outer faces of the tube.

2. The tube of claim 1, wherein the protruding swellings extend only on the same side of the tube as the outer faces of the tube.

3. The tube of claim 1, wherein the protruding swellings extend on the outer faces of the tube and extend on each border of the tube toward a joint linking the borders.

4. The tube of claim 1, wherein the protruding swellings have a dimension of approximately 0.05 mm to approximately 0.5 mm.

5. The tube of claim 1, wherein each of the borders is joined to an inner face of the tube by a fillet having a profile substantially of a quarter-circle.

6. The tube of claim 1, wherein the outer faces of the tube to which the borders are connected jointly form a flat large face of the tube.

7. The tube of claim 6, wherein the tube comprises two flat large faces joined together by two inward-curved small faces.

8. The tube of claim 1 formed from a metal material which is capable of being folded, aluminum or an aluminum-based material.

9. A method of shaping a tube for a heat exchanger, the tube comprising:

a metal strip folded on itself so as to delimit two parallel channels separated by a spacer, wherein the spacer comprises two borders of the metal strip joined together, each border folded at a right angle towards the interior of the tube from one of two outer faces of the tube to form a folded outer edge, wherein each of the folded outer edges includes a protruding swelling that extends at least on the same side of the tube as the outer faces of the tube, the method comprising the operations of:

a) providing a flat metal strip of chosen length delimited by two parallel longitudinal edges;

b) continuously deforming each of two marginal regions of the flat metal strip to produce a border forming a variable obtuse angle with a central region of the flat metal strip that extends between the borders, each border connected with the central region by a folded region of chosen profile;

c) carrying on with the deformation of the flat metal strip until each of the borders is connected to the central region by a right angle; and d) shaping the folded region to form a right angle having a folded outer edge that includes a protruding swelling.

10. The method of claim 9, wherein, in operation b), the folded region includes a protruding rib with rounded profile which protrudes on the same side as a reflex angle, wherein, in operation c), the protruding rib is conserved, and wherein, in operation d), the protruding rib is squeezed to form the protruding swelling.

11. The method of claim 9, wherein, in operation b), the folded region includes a fold with a rounded profile, wherein, in operation c) the fold is conserved, and wherein, in operation d) the material of each border is made to flow so as to fill in the internal space of the right angle and form the protruding swelling.

12. The method of claim 9, wherein each of the operations b), c) and d) is carried out at by least one set of shaping wheels including a shaping wheel and a counter-wheel.

13. The method of claim 9, further comprising the operation of:

e) continuously deforming the flat metal strip to bring the borders together against one another so that the borders jointly constitute the spacer, the borders reaching the central region of the flat metal strip to form the two parallel channels in the tube.

14. The method of claim 13, wherein operation e) comprises deforming the central region to form a flat large face joined by two inward-curved small faces to an opposed flat large face comprising a coplanar part extending to each of the borders.

15. A heat exchanger comprising a multiplicity of tubes, each tube comprising:

a metal strip folded on itself so as to delimit two parallel channels separated by a spacer, wherein the spacer comprises two borders of the metal strip joined together, each border folded at a right angle towards the interior of the tube from one of two outer faces of the tube to form a folded outer edge, wherein each of the folded outer edges includes a protruding swelling that extends at least on the same side of the tube as the outer faces of the tube.

16. A heat exchanger comprising a multiplicity of tubes obtained by the operations of:

a) providing a flat metal strip of chosen length delimited by two parallel longitudinal edges;

b) continuously deforming each of two marginal regions of the flat metal strip to produce a border forming a variable obtuse angle with a central region of the flat metal strip that extends between the borders, each border connected with the central region by a folded region of chosen profile;

c) carrying on with the deformation of the flat metal strip until each of the borders is connected to the central region by a right angle; and d) shaping the folded region to form a right angle having a folded outer edge that includes a protruding swelling.

17. A tube for a heat exchanger, the tube formed from a metal strip that has been folded, the tube having an interior surface and an exterior surface and delimiting parallel channels, the tube comprising:

a first large face;

two curved small faces, each curved small face extending from an end of the first large face, each curved small face substantially perpendicular to the first large face;

a first outer face and a second outer face, each outer face extending from an end of one of the two curved small faces, each outer face substantially perpendicular to the two curved small faces and parallel to the first large face, the first outer face and the second outer face jointly forming a second large face, and thereby delimiting an interior space;

a first border and a second border, each border extending substantially perpendicular to the second large face and towards the first large face, the first border and the second border jointly forming a spacer that divides the interior space into the parallel channels;

a first fillet and a second fillet, the first fillet connecting the first outer face to the first border, the second fillet connecting the second outer face to the second border, each fillet having a protruding swelling that extends at least substantially perpendicular to the outer faces and away from the first large face.

18. The tube of claim 17 wherein each protruding swelling only extends substantially perpendicular to the outer faces and away from the first large face.

19. The tube of claim 17 wherein each protruding swelling extends substantially perpendicular to the outer faces and away from the first large face and also extends substantially perpendicular to one of the borders and toward the other of the borders.

20. The tube of claim 17 wherein each protruding swelling is approximately 0.05 mm to approximately 0.5 mm.

21. The tube of claim 17 wherein each fillet has a curved profile that is substantially that of a quarter-circle.

22. The tube of claim 17 formed from a metal material that is capable of being folded, aluminum or an aluminum-based material.

23. A heat exchanger comprising the tube of claim 17.

24. A method of shaping a tube for a heat exchanger, the method comprising the steps of:

providing a metal strip delimited by two parallel longitudinal edges;

deforming each of two marginal regions of the metal strip to produce two borders and a central region extending between the borders, each border connected with the central region by a folded region of a predetermined profile and forming a variable obtuse angle with the central region;

continuing to deform the metal strip until each border is connected to the central region by approximately a right angle; and shaping the folded region to form approximately a right angle having a folded outer edge that includes a protruding swelling.

25. The method of claim 24 wherein in the deforming step, the folded region includes a rib with a rounded profile that protrudes on a reflex angle to the variable obtuse angle;

in the continuing to deform step, the rib is conserved; and in the shaping step, the rib is squeezed to form the protruding swelling.

26. The method of claim 24 wherein, in the deforming step, the folded region includes a fold with a rounded profile;

in the continuing to deform step, the fold is conserved; and in the shaping step, the material of each border flows to fill the internal space of the approximately right angle and form the protruding swelling.

27. The method of claim 24 wherein each step is performed by at least one set of shaping wheels.

28. The method of claim 24, further comprising the step of:

continuously deforming the metal strip to bring the borders against one another, the borders touching the central region of the metal strip and jointly constituting the spacer, the spacer forming two parallel channels in the tube.

29. The method of claim 28 wherein the step of continuously deforming comprises:

deforming the central region to form a first large face, each end of the first large face connected via a curved small face to a coplanar portion that extends to one of the borders, the coplanar portions forming a second large face opposed to the first large face.

30. A heat exchanger comprising the tube formed by the method according to claim 24.

* * * * *